United States Patent [19]

Tachikawa et al.

[11] 4,132,878

[45] Jan. 2, 1979

[54] HIGH-FREQUENCY ENERGY APPARATUS

[75] Inventors: Hajime Tachikawa; Kenji Satoh; Mitsuru Watanabe, all of Yokohama, Japan

[73] Assignee: Hitachi Heating Appliances Co., Ltd., Japan

[21] Appl. No.: 771,917

[22] Filed: Feb. 25, 1977

[30] Foreign Application Priority Data

Feb. 26, 1976 [JP] Japan ..... 51-20286

[51] Int. Cl.[2] ..... H05B 9/06

[52] U.S. Cl. ..... 219/10.55 B; 126/21 A; 219/400

[58] Field of Search ..... 219/10.55 B, 10.55 D, 219/10.55 R, 10.55 M, 400, 411; 126/15 R, 15 A, 21 R, 21 A

[56] References Cited

U.S. PATENT DOCUMENTS

| | | | |
|---|---|---|---|
| 3,185,809 | 5/1965 | Bohm et al. | 219/10.55 B |
| 3,281,568 | 10/1966 | Haagensen | 219/10.55 B |
| 3,407,279 | 10/1968 | Greenberg | 219/10.55 B |
| 3,681,557 | 8/1972 | Suzuki et al. | 219/10.55 D |
| 3,783,219 | 1/1974 | Tateda | 219/10.55 D |
| 3,829,649 | 8/1974 | Igarashi | 219/10.55 B |

FOREIGN PATENT DOCUMENTS

| | | | |
|---|---|---|---|
| 2136219 | 1/1972 | Fed. Rep. of Germany | 219/10.55 B |

*Primary Examiner*—J. V. Truhe
*Assistant Examiner*—Bernard Roskoski
*Attorney, Agent, or Firm*—Craig & Antonelli

[57] ABSTRACT

In a high-frequency energy apparatus, a heat generating element is disposed on a ventilation path of the high-frequency energy apparatus, which path is channeled through a heating chamber. When the heating time is automatically controlled, external air is introduced into the heating chamber, and when the heating time is manually controlled by such a means as a timer, on the other hand, hot air which has been heated by the heat generating element is introduced into the heating chamber so that the deposition of dew on the wall of heating chamber and the obscuring of a viewing panel of the heating chamber due to moisture may be prevented.

14 Claims, 5 Drawing Figures

FIG. 1 PRIOR ART
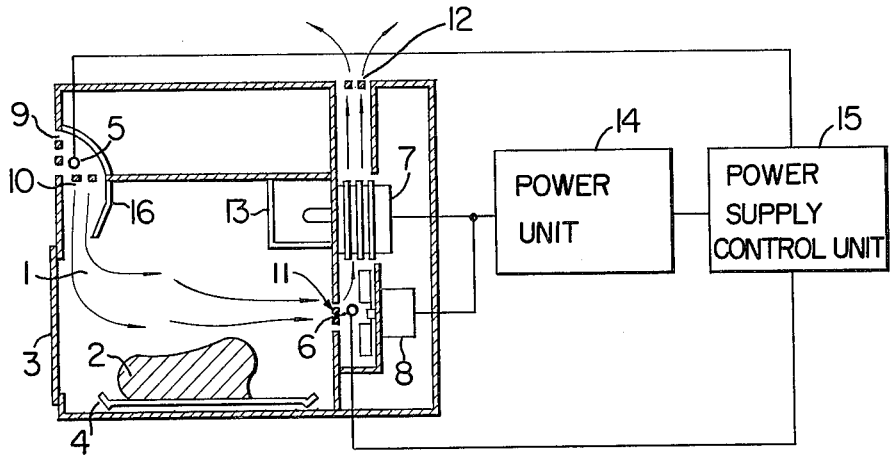
FIG. 2
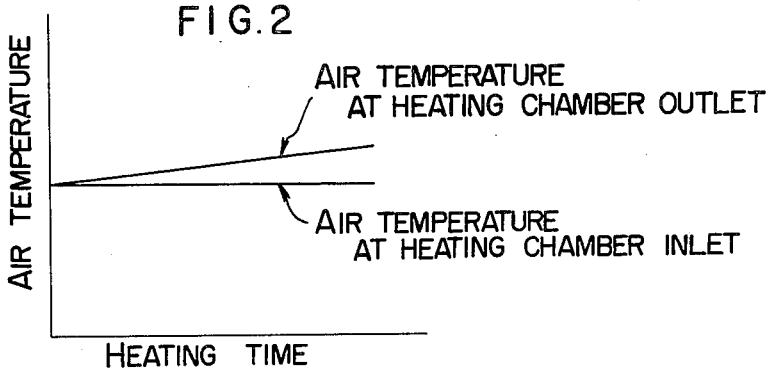
FIG. 3
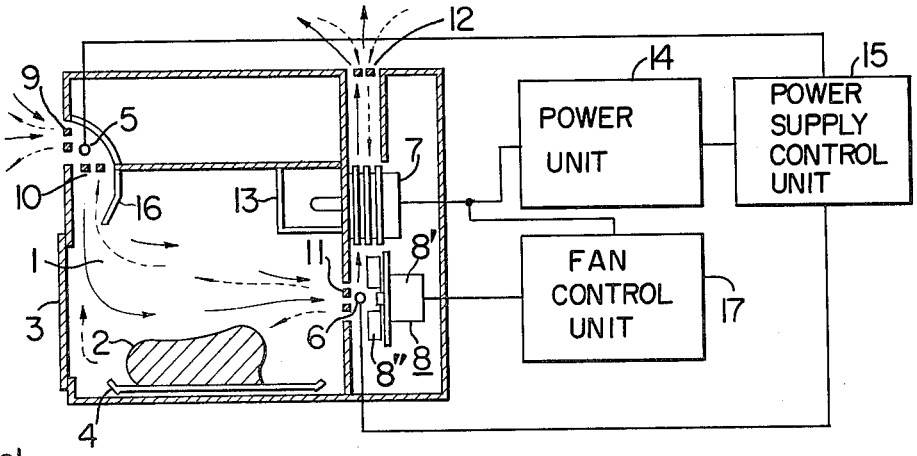
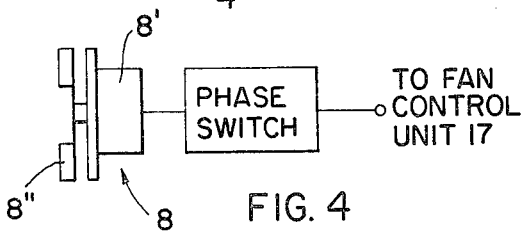
FIG. 4
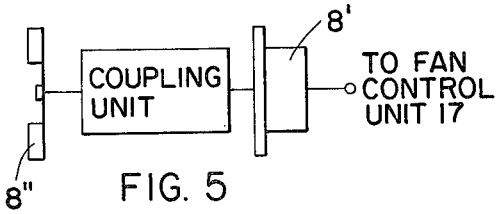
FIG. 5

HIGH-FREQUENCY ENERGY APPARATUS

FIELD OF THE INVENTION

This invention is concerned with preventing the deposition of dew in a high-frequency energy apparatus which includes a control mechanism for automatic proper heating of an object to be heated.

BRIEF DESCRIPTION OF THE DRAWING

In the accompanying drawings:

FIG. 1 is a schematic diagram of one example of prior art high-frequency energy apparatuses in which the temperature of the air flowing out of the heating chamber is sensed by control the supply of the high-frequency energy;

FIG. 2 is a graphical diagram showing the temperature rise characteristics of the air flowing into the heating chamber and that flowing out therefrom in the apparatus of FIG. 1; and FIG. 3 is a schematic diagram of one embodiment of this invention.

FIG. 4 is a schematic diagram of the fan drive assembly; and

FIG. 5 is a schematic diagram of an alternative embodiment of FIG. 4.

PRIOR ART OF THE INVENTION

As a method for detecting a heated state of an object to be heated to automatically control heating of the object in a high-frequency energy apparatus such as a microwave oven, proposals have conventionally been made as disclosed for example in U.S. Pat. Nos. 3,185,809 and 3,281,568, in which the temperature of air drawn out of a heating chamber or that of air within the heating chamber is sensed to indirectly or relatively measure the temperature of objects to be heated.

FIG. 1 illustrates one example of prior art high-frequency energy apparatuses that incorporate the above-mentioned conventional method. The apparatus of FIG. 1 comprises a heating chamber 1 where an object 2 to be heated is placed on a dish 4, an airtight door 3, an inlet temperature sensor 5 for sensing the temperature of air flowing into the heating chamber 1, an outlet temperature sensor 6 for sensing the temperature of air flowing out of the heating chamber 1, a high-frequency oscillating tube 7 directly coupled to the heating chamber, a cooling fan 8 provided for the high-frequency oscillating tube 7, an air inlet 9 for the apparatus, an air inlet 10 for the heating chamber, an air outlet 11 for the heating chamber, an air outlet 12 for the apparatus a partition plate 13 made of a high-frequency low energy loss material, a power unit 14, and a control unit 15. The sensors 5 and 6 are substantially shielded from the high-frequency energy emitted by the high-frequency oscillating tube 7. Arrows shown in the figure are indicative of the direction of air flow (in the succeeding figure, other arrows are also depicted for the same purpose).

When the power unit 15 is actuated, the high-frequency oscillating tube 7 starts to oscillate to feed high-frequency energy to the heating chamber 1, thereby heating the object 2. The high-frequency oscillating tube cooling fan 8 is also operated in a manner so that external air fed through the apparatus air inlet 9 is drawn into the heating chamber 1 via the heating chamber air inlet 10, guided by a guide plate 16 and the door 3 to pass through the lower space of the heating chamber 1 while passing by the object 2, drawn out of the heating chamber air outlet 11 to the exterior of the heating chamber 1 to be circulated by the high-frequency oscillating tube cooling fan 8 while cooling the high-frequency oscillating tube 7 and is finally exhausted out of the apparatus air outlet 12. In this circulation of the air, by sensing the temperature of the external air drawn into the heating chamber 1 by means of the inlet temperature sensor 5 and the temperature of the air drawn out of the heating chamber 1 by means of the outlet temperature sensor 6, as shown in FIG. 1, it has been found that, as shown in FIG. 2, the temperature of the air flowing into the heating chamber (i.e., external air) remains substantially constant but the temperature of the air flowing out of the heating chamber gradually rises with the heating time.

The temperature rise of the air flowing out of the heating chamber results from the temperature rise of the air within the heating chamber 1 when the object 2 to be heated is heated by the output energy of the high-frequency oscillating tube 7. Accordingly, it is possible to detect a heated state of the object to be heated by detecting the amount of the temperature rise of the air flowing out of the heating chamber (substantially equal to a difference in temperature between the air flowing into the heating chamber and that flowing out therefrom) during heating of the object. Thus, the heating time may automatically be controlled by controlling the power unit 14, which in turn controls the oscillation of the high-frequency oscillating tube 7, by means of the control unit 15 when a detected signal indicative of the amount of the temperature rise of the air flowing out of the heating chamber reaches a predetermined value. In accordance with the conventional apparatus as shown in FIG. 1, it is prohibited, in view of improving sensing accuracy, to feed into the heating chamber hot air, which has been previously heated by a heat generating element, other than the object to be heated. Further, in order to enhance the amount of the temperature rise of the air flowing out of the heating chamber due to the heat given off by the object, it is necessary to decrease the amount of ventilation for the heating chamber.

Typically, in the case where the heating time is automatically controlled by sensing the temperature of the air flowing out of the heating chamber, a prolonged heating will not be carried out under a vigorous generation of aqueous vapor (e.g., around a temperature of 100° C. of the object to be heated) from the view point of the prevention of damage to the object due to dehydration thereof, or a like cause, and hence the supply of the high-frequency energy is stopped, or the amount of the high-frequency energy is decreased, before such a vigorous generation of aqueous vapor occurs.

Accordingly, in the case of the automatic heat control in which, as mentioned above, it is prohibited from the viewpoint of improving controlling accuracies to feed into the heating chamber hot air which has been heated by a heat generating element, and in which the generation of aqueous vapor from the object to be heated is slight during heating, the problem of deposition will not be encountered even if, not only the external air is drawn into the heating chamber, but also the amount of ventilation for heating chamber is decreased to enhance the amount of the temperature rise in the air flowing out of the heating chamber.

In contrast thereto, in the case where the heating time is controlled by means of a manually operated control unit such as a timer or the like devices, heating continues even under a vigorous generation of aqueous vapor from the object to be heated until the manually set heating time of the timer has elapsed. In such a case, if the amount of ventilation for the heating chamber is small, the ability for evacuating aqueous vapor generated is so poor that the aqueous vapor dominantly prevails within the heating chamber 1. This leads to the deposition of dew on the wall of the heating chamber and obscuring of the viewing window possibly provided for the door 3 of the high-frequency energy apparatus. Thus, the user's good visibility of the object 2 to be heated through the viewer or window is impaired.

SUMMARY OF THE INVENTION

This invention contemplates to obviate the above drawbacks of the prior art and it is a main object of this invention to provide a high-frequency energy apparatus with an automatic heating time control mechanism and a manual heating time control mechanism using a timer or the like devices in which the deposition of dew on the wall of heating chamber and obscuring of a viewing window are prevented.

The above object can be accomplished, in accordance with this invention, by providing a high-frequency energy apparatus which comprises a heat generating element disposed in the ventilation path of the high-frequency energy apparatus, which is channeled through a heating chamber, wherein when the heating time is automatically controlled, external air is drawn into the heating chamber, and when the heating time is controlled by manually setting a timer or the like devices, hot air which has been heated by the heat generating element is fed into the heating chamber, so that the deposition of dew on the wall of the heating chamber and obscuring of a viewing window may be prevented.

Other objects and advantages of this invention may be understood more fully from the following detailed description by referring to the accompanying drawings.

PREFERRED EMBODIMENTS OF THE INVENTION

FIG. 3 illustrates a high-frequency energy of apparatus embodying invention. In this figure, members and units corresponding to those of FIG. 1 are designated by identical reference numerals. As will be seen in FIG. 3, a high-frequency energy apparatus of this invention additionally comprises a control unit 17 for controlling the direction of rotation of the fan. With the high-frequency energy apparatus of FIG. 3, for automatic control of the heating time by sensing the temperature of air drawn out of the heating chamber 1, the fan 8 is controlled by the fan rotation direction control unit 17 to rotate in the same direction as occurs in the prior art apparatus of FIG. 1 in order to feed the external air into the heating chamber through the inlets 9 and 10 as shown in the direction of the solid line arrows in FIG. 3. On the other hand, for manual control of the high-frequency energy apparatus by using a timer or the like devices, the fan 8 is controlled by the fan rotation direction control unit 17 to rotate in a reverse direction to the prior art apparatus, and as shown in FIG. 3 by the broken line arrows establish ventilation in the reverse direction so that hot air which has been heated by cooling the high-frequency oscillating tube 7 is fed into the heating chamber 1.

With this construction, when the heating time is controlled by an automatic control unit, the problem of the dew deposition will not be encountered for the reasons set forth above. When the heating time is controlled by a manual control unit such as a timer or the like devices, on the other hand, there is no need for sensing the temperature of the air flowing out of the heating chamber, and hence, it is possible to feed into the heating chamber 1 hot air which would give rise to degradation of the controlling accuracies in the case of the heating time control by the automatic control unit. Obviously, the hot air prevents the aqueous vapor given off by the object to be heated from being cooled easily with the result that the tendency for deposition of dew is suppressed even when a prolonged heating is carried out by the manual timer under a condition where a large amount of aqueous vapors could be readily generated in the prior art apparatus.

Taking into account the above characteristics inherent to the automatic and manual control of the heating time, in accordance with this invention, the direction of ventilation for the heating chamber is changed in such a manner that the external air is drawn into the heating chamber when the heating time is controlled automatically, whereas hot air is drawn into the heating chamber when the heating time is controlled manually. Specifically, the fan rotation direction control unit 17 comprises means for reversing the polarity of supplied voltage for the high-frequency oscillating tube cooling fan 8 in the case the motor 8' for driving the blade assembly 8'' of the fan is a DC motor or means for shifting phases of supplied voltages for the high-frequency oscillating tube cooling fan 8 in the case the motor 8' for driving the blade assembly 8'' of the fan is a three-phase AC motor as seen in FIG. 4. Alternatively, i.e., in place of the above electrical method of controlling the direction of fan rotation, the rotation of the high-frequency oscillating tube cooling fan 8 may be reversed mechanically by providing a reversibly rotatable coupling unit seen in FIG. 5 between the motor 8' and the blade assembly 8'' of the fan 8. Typically, a clutch mechanism with idler gears may be used as such a coupling unit.

As has been described, in accordance with this invention, in the case where the heating time is automatically controlled by sensing the temperature of the air flowing out of the heating chamber, the external air is drawn into the heating chamber and before the aqueous vapors given off by the object to be heated prevail dominantly in the heating chamber, heating is stopped or the supply of high-frequency energy is decreased thereby to prevent the deposition of dew on the wall of the heating chamber and the obscuring the window. In the case where the heating time is manually controlled by means of a timer or the like devices, on the other hand, the direction of ventilation for the heating chamber is reversed to pass hot air to the heating chamber so that the aqueous vapors given off by the object to be heated can only be slightly cooled, thereby preventing the deposition of dew on the wall of the heating chamber. Accordingly, there is no need for wiping off the inner wall of the heating chamber and the viewing window is prevented from being obscured, thereby ensuring the user's visibility of the object to be heated which is placed in the heating chamber.

While, in the foregoing embodiments, the direction of ventilation for the heating chamber has been changed in accordance with modes of the automatic control and the manual control, the effects of this invention may be enhanced by increasing the amount of ventilation for the heating chamber in the when the manual control mechanism is selectively actuated, relative to the case when the automatic control mechanism is selectively actuated.

Further, it should be noted that, in the foregoing embodiments, the outlet temperature sensor 6 may be replaced by a temperature sensor (not shown) disposed in the heating chamber to detect the temperature of air in the heating chamber without degrading the effects of this invention.

I claim:

1. A high-frequency energy apparatus comprising:

a casing constituting a heating chamber for accommodating an object to be heated;

a high-frequency energy generator operative to generate high-frequency energy and feeding it to said heating chamber;

means for ventilating said heating chamber, said ventilating means including a ventilation path constituted in part by the space of said heating chamber;

first heating time control means for automatically controlling the heating time, said first heating time control means including temperature sensor means for sensing at least one of temperatures of the air within said haeting chamber and of the air drawn out of said heating chamber, and means for controlling said high-frequency energy generator to change the amount of supply of the high-frequency energy from said generator when the temperature sensed by said temperature sensor means reaches a predetermined value;

second heating time control means for manually controlling the heating time;

heat generating means disposed on a part of said ventilation path which is exterior of the heating chamber for generating heat;

means for selectively actuating said first and said second heating time control means to change heating time control mode between an automatic heating time control mode and a manual heating time control mode, respectively; and means responsive to said heating time control mode changing means, for changing the direction of ventilation established by said ventilating means in a manner so that the heat generated by said heat generating means is respectively exhausted from said apparatus and introduced into said heating chamber during said automatic and said manual heating time control modes.

2. A high-frequency energy apparatus according to claim 1, wherein said ventilation direction changing means determines, when said first heating time control means is selectively actuated, a first ventilation direction in which an air flow for the ventilation is passed through said heat generating means after being passed through said heating chamber, and determines, when said second heating time control means is selectively actuated, a second ventilation direction in which the air flow for the ventilation is passed through said heating chamber after being passed through said heat generating means.

3. A high-frequency energy apparatus according to claim 1, wherein said ventilating means includes an electrical-motor-driven fan disposed on said ventilation path, said fan being arranged suitably for ventilating said heating chamber by said ventilation path.

4. A high-frequency energy apparatus according to claim 3, wherein said ventilating means includes a DC motor for driving said fan, and wherein said ventilation direction changing means includes means for switching over the polarity of said DC motor in a manner so that the heat generated by said heat generating means is respectively exhausted from said apparatus and introduced into said heating chamber during said automatic and said manual heating time control modes by said fan.

5. A high-frequency energy apparatus according to claim 3, wherein said ventilating means includes a three-phase AC motor for driving said fan, and wherein said ventilation direction changing means includes means for switching over the phase of said three-phase AC motor in a manner so that the heat generated by said heat generating means is respectively exhausted from said apparatus and introduced into said heating chamber during said automatic and said manual heating time control modes by said fan.

6. A high-frequency energy apparatus according to claim 3, wherein said electrical motor-driven fan includes a motor and a blade assembly and said ventilation direction changing means includes coupling means for reversibly and rotatbly coupling said blade assembly with said motor, the rotating direction of said blade assembly being controlled by said coupling means in a manner so that the heat generating means is respectively exhausted from said apparatus and introduced into said heating chamber during said automatic and said manual heating time control modes by said blade assembly.

7. A high-frequency energy apparatus comprising:

a casing constituting a heating chamber for accommodating an object to be heated;

a high-frequency energy generator operative to generate high-frequency energy and feeding it to said heating chamber;

means for ventilating air in said heating chamber, said ventilating means including a ventilation path constituted in part by said heating chamber;

first heating time control means for automatically controlling the heating time, said first heating time control means including temperature sensor means for sensing at least one of temperatures of the air within said heating chamber and of the air drawn out of said heating chamber, and means for controlling said high-frequency energy generator to change the amount of supply of the high-frequency energy from said generator when the temperature sensed by said temperature sensor means reaches a predetermined value;

second heating time control means for manually controlling the heating time;

heat generating means disposed on a part of said ventilation path which is exterior of the heating chamber for generating heat;

means for selectively actuating said first and said second heating time control means to change heating time control mode between an automatic heating time control mode and a manual heating time control mode, respectively;

means responsive to said heating time control mode changing means, for changing the direction of the ventilation established by said ventilating means in a manner so that the heat generated by said heat generating means is respectively exhausted from said apparatus and introduced into said heating chamber during said automatic and said manual heating time control modes;

means responsive to said heating time control mode changing means, for changing the amount of the ventilation established by said ventilating means in a manner so that the amount of the ventilation is increased in said manual heating time control mode more than in said automatic heating time control mode; and means for actuating both said ventilation direction changing means and said ventilation amount changing means in response to the selective actuation of said first and second heating time control means.

8. A high-frequency energy apparatus comprising:

a casing constituting a heating chamber for accommodating an object to be heated;

a high-frequency energy generator operative to generate high-frequency energy and feeding it to said heating chamber;

means for ventilating said heating chamber, said ventilating means including a ventilation path constituted in part by the space of said heating chamber, said high-frequency energy generator being disposed at a part of said ventilation path which is exterior of said heating chamber;

first heating time control means for automatically controlling the heating time, said first heating time control means including temperature sensor means for sensing at least one of temperatures of the air within said heating chamber and of the air drawn out of said heating chamber, and means for controlling said high-frequency energy generator to change the amount of supply of the high-frequency energy from said generator when the temperature sensed by said temperature sensor means reaches a predetermined value;

second heating time control means for manually controlling the heating time;

means for selectively actuating said first and second heating time control means to change heating time control mode between an automatic heating time control mode and a manual heating time control mode; and means, responsive to said heating time control mode changing means, for changing the direction of the ventilation established by said ventilating means in a manner so that the heat generated by said high-frequency energy generator is respectively exhausted from said apparatus and introduced into said heating chamber during said automatic and said manual heating time control modes.

9. A high-frequency energy apparatus according to claim 8, wherein said ventilation direction changing means determines, when said first heating time control means is selectively actuated, a first ventilation direction in which an air flow for the ventilation is passed by said high-frequency energy generator after being passed through said heating chamber, and determines, when said second heating time control means is selectively actuated, a second ventilation direction in which the air flow for the ventilation is passed through said heating chamber after being passed by said high-frequency energy generator.

10. A high-frequency energy apparatus according to claim 8, wherein said ventilating means includes an electrical-motor-driven fan disposed on said ventilation path, said fan being arranged suitably for cooling said high-frequency energy generator and for ventilating said heating chamber through said ventilation path.

11. A high-frequency energy apparatus according to claim 10, wherein said ventilating means includes a DC motor for driving said fan, and wherein said ventilation direction changing means includes means for switching over the polarity of said DC motor in a manner so that the heat generated by said high-frequency energy generator is respectively exhausted from said apparatus and introduced into said heating chamber during said automatic and said manual heating time control modes by said fan.

12. A high-frequency energy apparatus according to claim 10, wherein said ventilating means includes an AC three-phase motor for driving said fan, and wherein said ventilation direction changing means includes means for switching over the phase of said three-phase AC motor in a manner so that the heat generated by said high-frequency energy generator is respectively exhausted from said apparatus and introduced into said heating chamber during said automatic and said manual heating time control modes by said fan.

13. A high-frequency energy apparatus according to claim 10, wherein said electrical-motor-driven fan includes a motor and a blade assembly and said ventilation changing means includes coupling means for reversibly and rotatably coupling said blade assembly in a manner so that the heat generated by said high-frequency energy generator is respectively exhausted from said apparatus and introduced into said heating chamber during said automatic and said manual heating time control modes by said blade assembly.

14. A high-frequency energy apparatus comprising:

a casing constituting a heating chamber for accommodating an object to be heated;

a high-frequency energy generator operative to generate high-frequency energy and feeding it to said heating chamber;

means for ventilating said heating chamber, said ventilating means including a ventilation path constituted in part by the space of said heating chamber, said high-frequency energy generator being disposed at a part of said ventilation path which is exterior of said heating chamber;

first heating time control means for automatically controlling the heating time, said first heating time control means including temperature sensor means for sensing at least one of temperatures of the air within said heating chamber and of the air drawn out of said heating chamber, and means for controlling said high-frequency energy generator to change the amount of supply of the high-frequency energy from said generator when the temperature sensed by said temperature sensor means reaches a predetermined value;

second heating time control means for manually controlling the heating time;

means for selectively actuating said first and second heating time control means to change heating time control mode between an automatic heating time control mode and a manual heating time control mode;

means responsive to said heating time control mode changing means, for changing the direction of the ventilation established by said ventilating means in a manner so that the heat generated by said high-frequency energy generator is respectively exhausted from said apparatus and introduced into said heating chamber during said automatic and said manual heating time control modes;

means responsive to said heating time to control mode changing means, for changing the amount of the ventilation established by said ventilating means in a manner so that the amount of the ventilation is increased in said manual heating time control mode more than in said automatic heating time control mode; and means for actuating both said ventilation direction changing means and said ventilation amount changing means in response to the selective actuation of said first and second heating time control means.

* * * * *